US009901192B2

(12) United States Patent
Tiggett, Jr.

(10) Patent No.: US 9,901,192 B2
(45) Date of Patent: Feb. 27, 2018

(54) ROBOTIC MANNEQUIN SYSTEM

(71) Applicant: James Tiggett, Jr., Philadelphia, PA (US)

(72) Inventor: James Tiggett, Jr., Philadelphia, PA (US)

( * ) Notice: Subject to any disclaimer, the term of this patent is extended or adjusted under 35 U.S.C. 154(b) by 38 days.

(21) Appl. No.: 14/979,767

(22) Filed: Dec. 28, 2015

(65) Prior Publication Data

US 2017/0181553 A1 Jun. 29, 2017

(51) Int. Cl.
*A47F 8/00* (2006.01)
*G09F 19/02* (2006.01)

(52) U.S. Cl.
CPC ..... *A47F 8/00* (2013.01); *G09F 19/02* (2013.01)

(58) Field of Classification Search
CPC ..... G09F 19/00; G09F 19/02; G09F 19/08; G09F 19/088; G09F 5/00; G09F 2027/002; A61H 19/44; A47F 8/00; A47F 8/02
See application file for complete search history.

(56) References Cited

U.S. PATENT DOCUMENTS 2,059,338 A 11/1936 Goddsill
3,973,840 A 8/1976 Jacobs et al.
5,265,779 A 11/1993 Jiang
6,198,247 B1 * 3/2001 Barr ..... G09F 19/08 318/568.1
6,257,467 B1 7/2001 Chen
6,467,908 B1 10/2002 Mines et al.
6,695,770 B1 * 2/2004 Choy ..... A61H 19/44 600/38
7,712,640 B2 5/2010 Honer et al.
8,189,000 B2 5/2012 Weaver
2006/0124673 A1 * 6/2006 Matsui ..... A47F 8/00 223/120
2011/0003529 A1 1/2011 Ehrsam
2013/0186922 A1 7/2013 Soto Velasco
2013/0292428 A1 * 11/2013 Catanese ..... A47F 8/00 223/84
2014/0253819 A1 9/2014 Walton

FOREIGN PATENT DOCUMENTS

JP 2004057223 A * 2/2004
JP 2009291502 A * 6/2008
JP 2013094923 A * 5/2013
KR 2005071147 A * 7/2005

* cited by examiner

*Primary Examiner* — Ismael Izaguirre

(57) ABSTRACT

A robotic mannequin system includes a plurality of articles of clothing. A mannequin is provided. The mannequin has a torso, a pair of arms, a pair of legs and a head. Each of the articles of clothing is worn on the mannequin such that the mannequin displays the articles of clothing. An actuating array is coupled to the mannequin. The actuating array is in mechanical communication with the arms, the legs and the head. The actuating array urges each of the arms, the first legs and the head to move with respect to the torso. Thus, the mannequin may mimic human motion. Each of the arms, the first legs and the head position the articles of clothing in a selected pose. Thus, the mannequin may enhance an appearance of the articles of clothing.

9 Claims, 6 Drawing Sheets

ROBOTIC MANNEQUIN SYSTEM

BACKGROUND OF THE DISCLOSURE

Field of the Disclosure

The disclosure relates to mannequin devices and more particularly pertains to a new mannequin device for advertising articles of clothing.

SUMMARY OF THE DISCLOSURE

An embodiment of the disclosure meets the needs presented above by generally comprising a plurality of articles of clothing. A mannequin is provided. The mannequin has a torso, a pair of arms, a pair of legs and a head. Each of the articles of clothing is worn on the mannequin such that the mannequin displays the articles of clothing. An actuating array is coupled to the mannequin. The actuating array is in mechanical communication with the arms, the legs and the head. The actuating array urges each of the arms, the first legs and the head to move with respect to the torso. Thus, the mannequin may mimic human motion. Each of the arms, the first legs and the head position the articles of clothing in a selected pose. Thus, the mannequin may enhance an appearance of the articles of clothing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
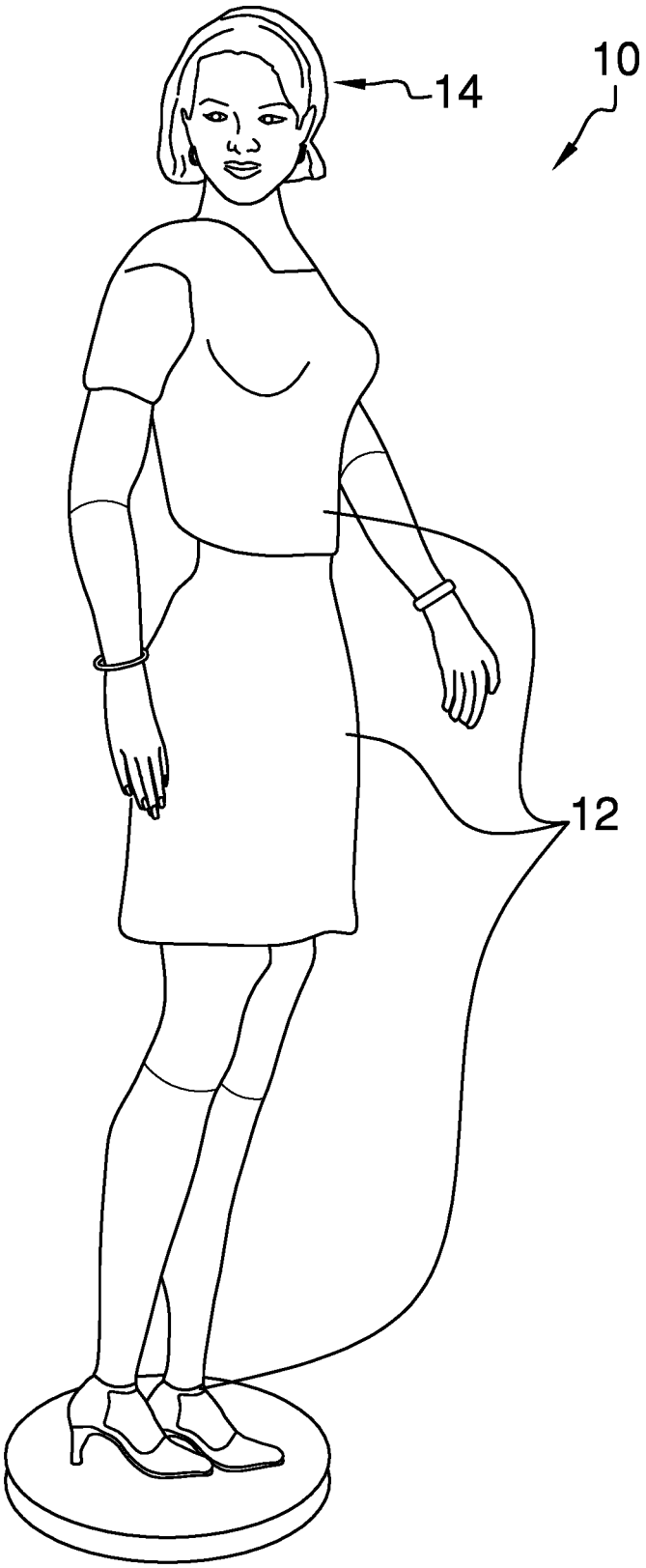
FIG. 1 is a perspective view of a robotic mannequin system according to an embodiment of the disclosure.
Figure 2:
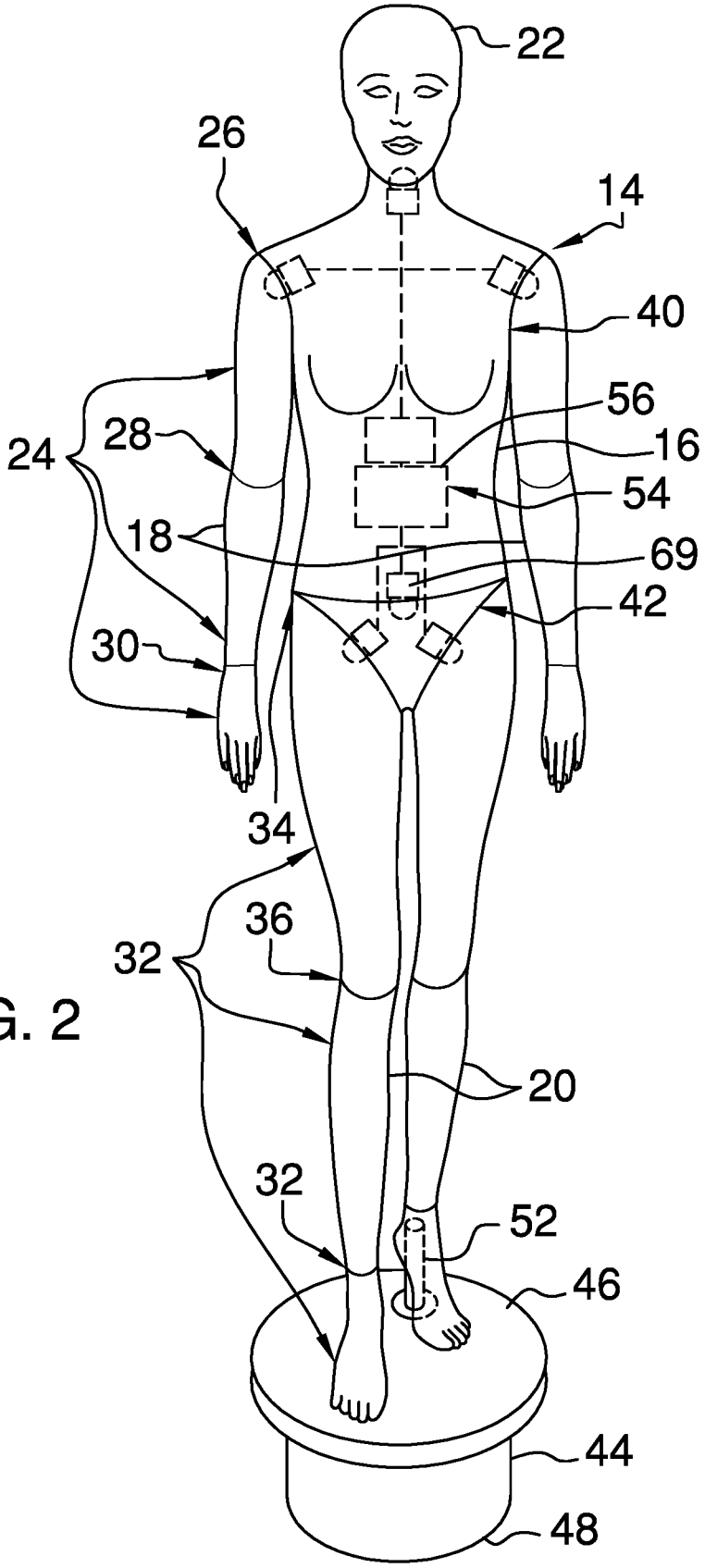
FIG. 2 is a front phantom view of an embodiment of the disclosure.
Figure 3:
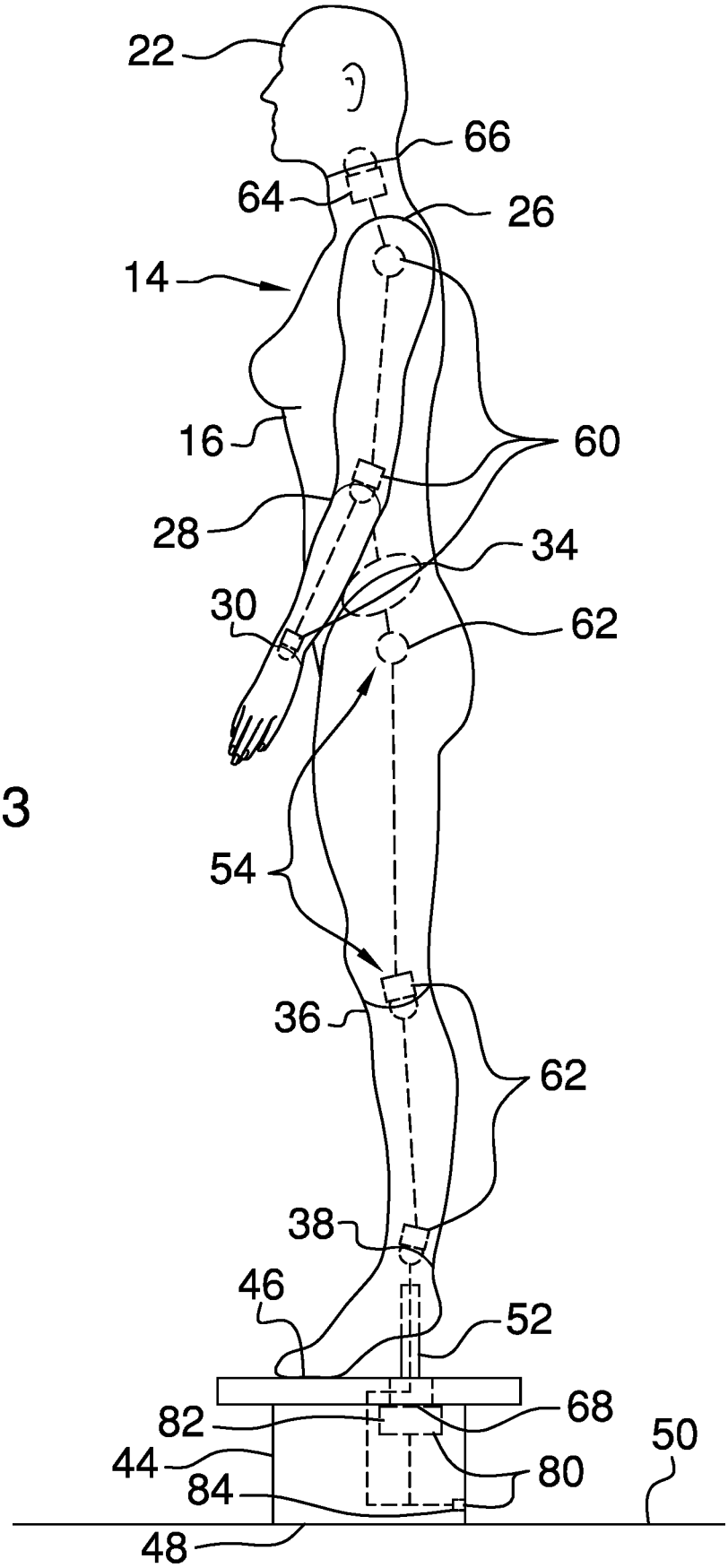
FIG. 3 is a left side phantom view of an embodiment of the disclosure.
Figure 4:
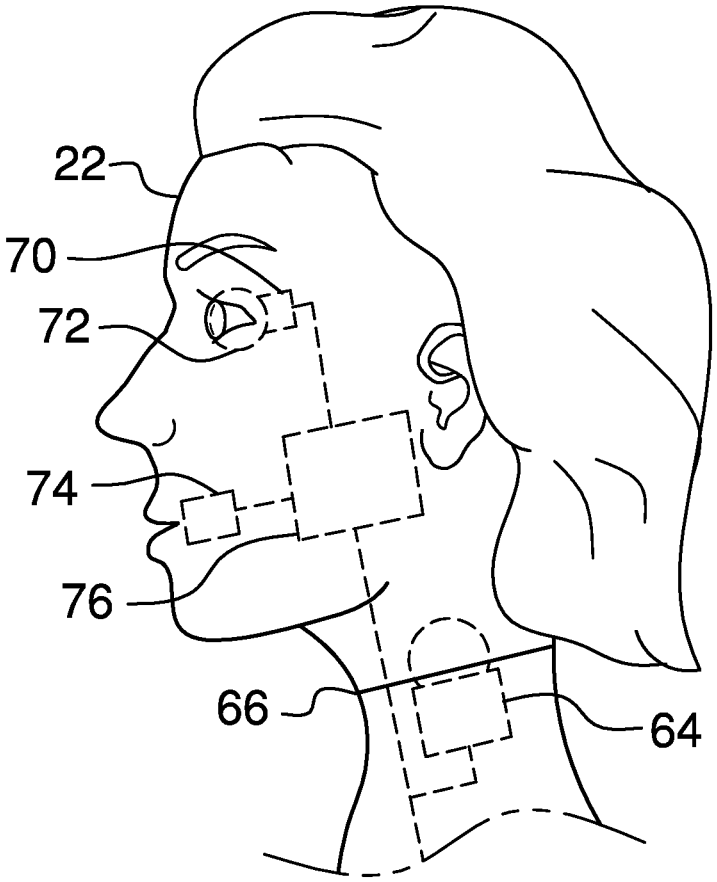
FIG. 4 is a perspective phantom view of an embodiment of the disclosure.
Figure 5:
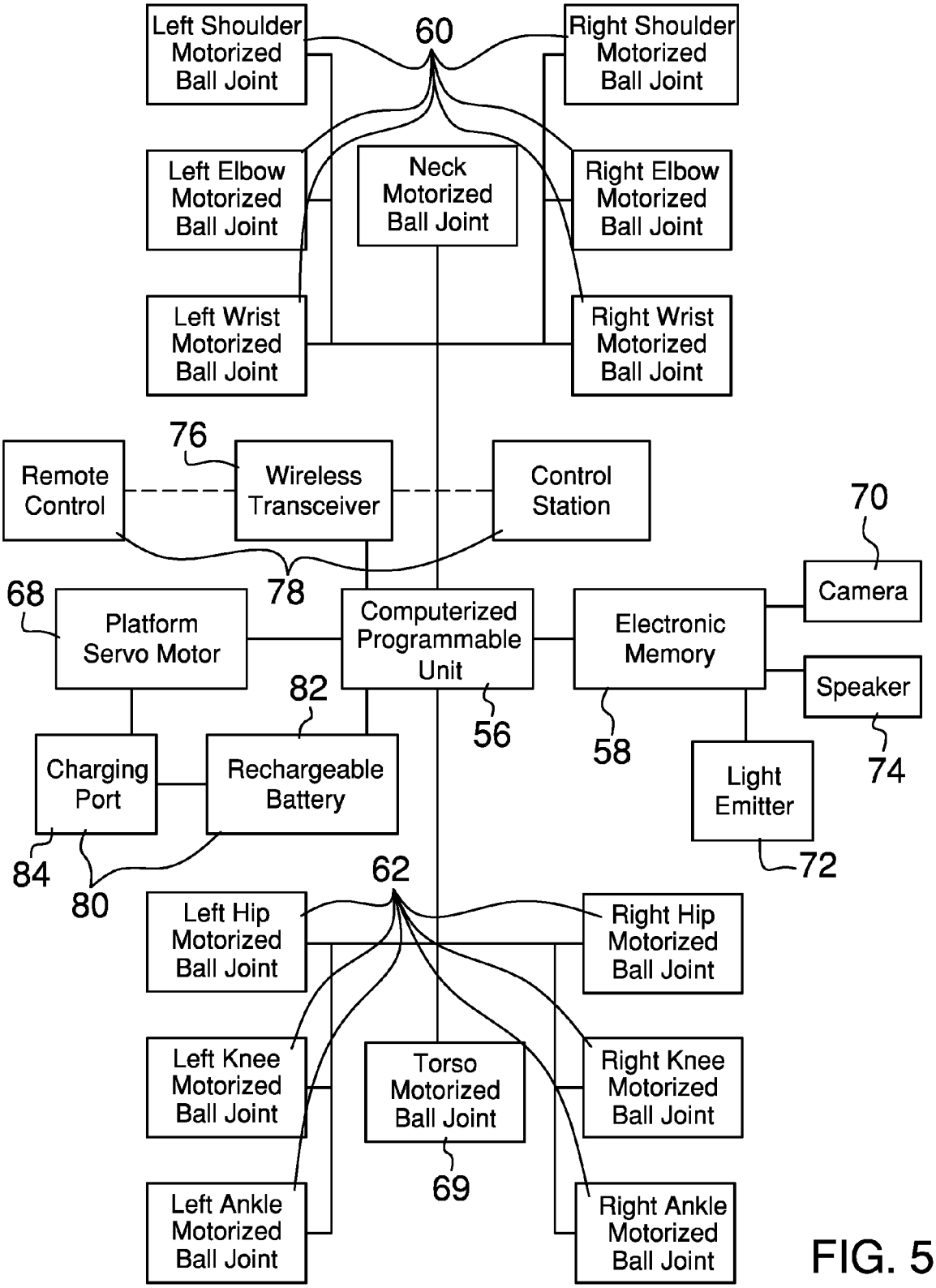
FIG. 5 is a schematic view of an embodiment of the disclosure.
Figure 6:
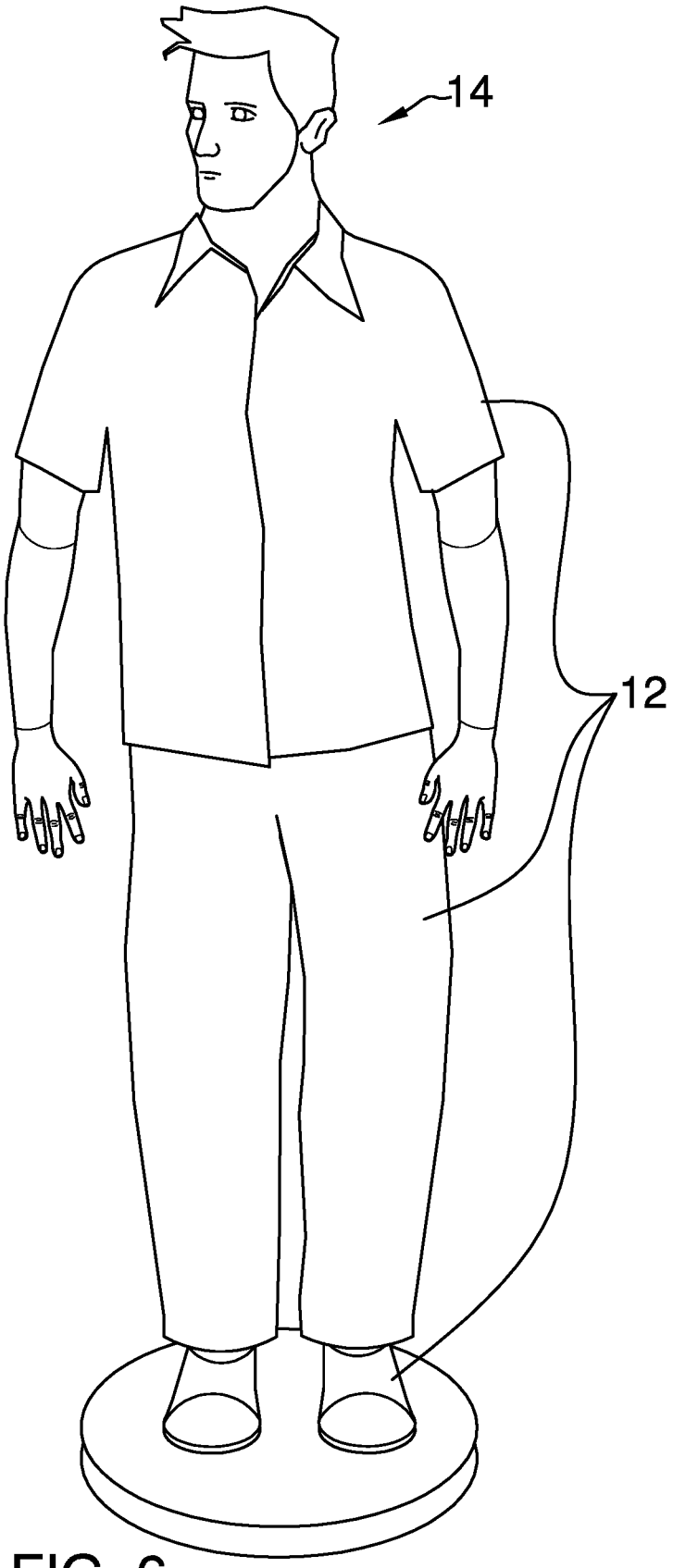
FIG. 6 is a front perspective view of an embodiment of the disclosure.

With reference now to the drawings, and in particular to FIGS. 1 through 6 thereof, a new mannequin device embodying the principles and concepts of an embodiment of the disclosure and generally designated by the reference numeral 10 will be described.

As best illustrated in FIGS. 1 through 6, the robotic mannequin system 10 generally comprises a plurality of articles of clothing 12. The articles of clothing 12 may comprise male clothing or female clothing. Additionally, the articles of clothing 12 may include any article of clothing worn for any purpose. The articles of clothing 12 may be articles of clothing sold in a retail environment or the like.

A mannequin 14 is provided. The mannequin 14 has a torso 16, a pair of arms 18, a pair of legs 20 and a head 22. Each of the pair of arms 18 is movably coupled to the torso 16 and each of the pair of legs 20 is movably coupled to the torso 16. The head 22 is movably coupled to the torso 16. Each of the articles of clothing 12 is worn on the mannequin 16 such that the mannequin 16 displays the articles of clothing 12. The mannequin 14 may be positioned in the retail environment such that the mannequin 14 is visible to observers. The mannequin 14 may be a female mannequin and a male mannequin.

Each of the arms 18 has a plurality of movable sections 24. Each of the movable sections 24 defines a shoulder 26, and elbow 28 and a wrist 30 of each of the arms 18. Each of the legs 20 has a plurality of movable sections 32. Each of the movable sections 32 corresponding to the legs 20 defines a hip 34, a knee 36 and an ankle 38 of each of the legs 20. The torso 16 includes a top section 40 movably coupled to a bottom section 42. Each of the legs 20 is movably coupled to the bottom section 42 and each of the arms 18 is movably coupled to the top section 40. The head 22 is movably coupled to the top section 40.

A base 44 is provided and the mannequin 14 is coupled to the base 44. The base 44 retains the mannequin 14 in an upright position. The base 44 has a top end 46 and a bottom end 48. The bottom end 48 may be positioned on a support surface 50 and the mannequin 14 is positioned on the top end 46. The support surface 50 may comprise a floor or the like.

A rod 52 is rotatably coupled to the base 44. The rod 52 extends upwardly from the top end 46. The rod 52 extends upwardly into an associated one of the legs 20. Thus, the mannequin 14 is movably coupled to the base 44.

An actuating array 54 is coupled to the mannequin 14. The actuating array 54 is in mechanical communication with each of the arms 18, each of the legs 20 and the head 22. The actuating array 54 urges each of the arms 18, each of the legs 20 and the head 22 to move with respect to the torso 16. Thus, the mannequin 14 mimics human motion. Each of the arms 18, each of the legs 20 and the head 22 position the articles of clothing 12 in a selected pose. Thus, the mannequin 14 enhances an appearance of the articles of clothing 12 in the retail environment.

The actuating array 54 comprises a processor 56 that is positioned within the mannequin 14. The processor 56 includes an electronic memory 58 and the electronic memory 58 may store a movement routine. The processor 56 may comprise an electronic processor or the like. The electronic memory 58 may comprise RAM, a hard disk drive or other form of electronic data storage.

A plurality of arm motors 60 is provided. Each of the arm motors 60 is electrically coupled to the processor 56 such that the processor 56 selectively actuates each of the arm motors 60. Each of the arm motors 60 is positioned within the mannequin 14. Each of the arm motors 60 is positioned at an associated one of the shoulder 26, the elbow 28 and the wrist 30 of an associated one of the arms 18. Thus, the arm motors 60 urge each of the arms 18 to move in the selected direction with respect to the torso 16. Each of the arm motors 60 may comprise an electrical ball joint or the like. Each of the arm motors 60 may articulate within a one hundred eighty degree range of motion.

A plurality of leg motors 62 is provided. Each of the leg motors 62 is electrically coupled to the processor 56 such that the processor 56 selectively actuates each of the leg motors 62. Each of the leg motors 62 is positioned within the mannequin 14. Each of the leg motors 62 is positioned at an associated one of the hip 34, the knee 36 and the ankle 38 of an associated one of the legs 20. Thus, the leg motors 62 urge each of the legs 20 to move in a selected direction with respect to the torso 16. Each of the leg motors 62 may comprise an electrical ball joint or the like. Each of the leg motors 62 may articulate within a one hundred eighty degree range of motion.

A head motor 64 is positioned within the mannequin 14. The head motor 64 is electrically coupled to the processor 56 such that the processor 56 selectively actuates the head motor 64. The head motor 64 is positioned at a neck 66 between the head 22 and the torso 16. Thus, the head motor 64 urges the head 22 to move with respect to the torso 16. The head motor 64 may comprise an electrical ball joint or the like. The head motor 64 may articulate within a one hundred eighty degree range of motion.

A rod motor 68 is positioned within the base 44. The rod motor 68 is electrically coupled to the processor 56 such that the processor 56 selectively actuates the rod motor 68. The rod motor 68 is coupled to the rod 52 such that the rod motor 68 rotates the rod 52. Thus, the mannequin 14 rotates on the base 44. A torso motor 69 is coupled between the top section 40 and the bottom section 42 of the torso 16. The torso motor 69 urges the top section 40 to move with respect to the bottom section 42.

A camera 70 is coupled to the head 22. The camera extends outwardly from the head 22 and the camera 70 may record images. The camera 70 is electrically coupled to the processor 56. The camera 70 may be aligned with one of a pair of eyes on the head 22. The camera 70 may comprise a digital camera or the like.

A light emitter 72 is coupled to the camera 70 and the light emitter 72 extends outwardly from the head 22. The light emitter 72 may be structured to substantially resemble a human eye. The light emitter 72 emits one of a plurality of colors of light. Thus, the light emitter 72 may mimic the ornamental appearance of a human eye having a selected color. The light emitter 72 may comprise an LED or the like.

A speaker 74 is coupled to the head 22 and the speaker 74 may emit audible sounds. The speaker 74 is electrically coupled to the processor 56. The audible sounds may comprise a pre-recorded phrase stored within the electronic memory 58. The speaker 74 may comprise an audio speaker or the like.

A transceiver 76 is positioned within the mannequin 14 and the transceiver 76 is electrically coupled to the processor 56. The transceiver 76 may be in communication with an extrinsic electronic device 78. The extrinsic electronic device 78 may comprise a personal computer or the like and the extrinsic electronic device 78 stores the movement routine. Thus, the extrinsic electronic device 78 may communicate the movement routine to the electronic memory 58. The transceiver 76 may comprise a radio frequency transceiver or the like. The extrinsic electronic device 78 may include a remote control for controlling the movement of the mannequin 14.

The movement routine may comprise a plurality of poses. The mannequin 14 may be sequentially positioned in each of the poses. The mannequin 14 may remain in each of the poses for a selected duration of time. Alternatively, the mannequin 14 may continually move between the poses. The movement routine may comprise a plurality of random poses and the movement routine may comprise a plurality of selected poses. The selected poses may correspond to poses employed in the convention of fashion modeling.

A power supply 80 is positioned within the base 44 and the power supply 80 is electrically coupled to the processor 56. The power supply 80 comprises at least one battery 82. The power supply 80 further comprises a power port 84 that is coupled to the base 44. The power port 84 is electrically coupled to the battery 82 such that the power port 84 charges the battery 82. A cord may be electrically coupled between the power port 84 and a power source. The power source may comprise an electrical outlet or the like.

In use, the articles of clothing 12 are worn on the mannequin 14. The movement routine is determined on the extrinsic electronic device 78. The movement routine is communicated to the electronic memory 58. Each of the arms 18, each of the legs 20 and the head 22 moves in accordance with the movement routine. Thus, the articles of clothing 12 are positioned in various poses thereby enhancing the ornamental appearance of the articles of clothing 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A robotic mannequin system comprising:

a plurality of articles of clothing;

a mannequin having a torso, a pair of arms, a pair of legs and a head, each of said pair of arms being movably coupled to said torso, each of said pair of legs being movably coupled to said torso, said head being movably coupled to said torso, each of said articles of clothing being worn on said mannequin such that said mannequin displays said articles of clothing;

a base having said mannequin being coupled thereto such that said mannequin is retained in an upright position, said base having a top end and a bottom end, said bottom end being configured to be positioned on a support surface, said mannequin being positioned on said top end;

a rod being rotatably coupled to said base, said rod extending upwardly from said top end, said rod extending upwardly through a heel portion of an associated one of said legs of said mannequin and into said associated one of said legs such that said mannequin is movably coupled to said base, said heel portion being aligned with a foot portion being angled away from said heel portion such that said foot portion extends in alignment with said rod wherein said foot portion is configured to partially obscure said rod portion from being viewed;

an actuating array being coupled to said mannequin, said actuating array being in mechanical communication with said arms, said legs and said head, said actuating array urging each of said arms, said legs and said head to move with respect to said torso wherein said mannequin is configured to mimic human motion, each of said arms said leg and said head positioning said articles of clothing in a selected pose wherein said mannequin is configured to enhance an appearance of said articles of clothing, said actuating array including a processor being positioned within said mannequin, said processor including an electronic memory, said electronic memory being configured to store a movement routine; and a rod motor being positioned within said base, said rod motor being electrically coupled to said processor such that said processor selectively actuates said rod motor, said rod motor being coupled to said rod such that said rod motor rotates said rod having said mannequin rotating on said base.

2. The system according to claim 1, wherein said actuating array comprises a processor being positioned within said mannequin, said processor including an electronic memory, said electronic memory being configured to store a movement routine.

3. The system according to claim 2, further comprising a plurality of arm motors, each of said arm motors being electrically coupled to said processor such that said processor selectively actuates each of said arm motors, each of said arm motors being positioned within said mannequin, each of said arm motors being positioned at an associated one of a shoulder, an elbow and a wrist of an associated one of said arms, said arm motors urging each of said arms to move in a selected direction with respect to said torso.

4. The system according to claim 2, further comprising a plurality of leg motors, each of said leg motors being electrically coupled to said processor such that said processor selectively actuates each of said leg motors, each of said leg motors being positioned within said mannequin, each of said leg motors being positioned at an associated one of a hip, a knee and an ankle of an associated one of said legs, said leg motors urging each of said legs to move in a selected direction with respect to said torso.

5. The system according to claim 2, further comprising a head motor being positioned within said mannequin, said head motor being electrically coupled to said processor such that said processor selectively actuates said head motor, said head motor being positioned at a neck between said head and said torso, said head motor urging said head to move with respect to said torso.

6. The system according to claim 2, further comprising:

a camera being coupled to said head wherein said camera is configured to record images, said camera being electrically coupled to said processor; and a speaker being coupled to said head wherein said speaker is configured to emit audible sounds, said speaker being electrically coupled to said processor.

7. The system according to claim 2, further comprising a transceiver being positioned within said mannequin, said transceiver being electrically coupled to said processor, said transceiver being configured to be in communication with an extrinsic electronic device thereby facilitating the extrinsic electronic device to communicate the movement routine to said electronic memory.

8. The system according to claim 2, further comprising a power supply being positioned within said base, said power supply being electrically coupled to said processor, said power supply comprising at least one battery, said power supply further comprising a power port being coupled to said base, power port being electrically coupled to said battery such that said power port charges said battery, said power port being configured to be electrically coupled to a power source.

9. A robotic mannequin system comprising:

a plurality of articles of clothing;

a mannequin having a torso, a pair of arms, a pair of legs and a head, each of said pair of arms being movably coupled to said torso, each of said pair of legs being movably coupled to said torso, said head being movably coupled to said torso, each of said articles of clothing being worn on said mannequin such that said mannequin displays said articles of clothing;

a base having said mannequin being coupled thereto such that said mannequin is retained in an upright position, said base having a top end and a bottom end, said bottom end being configured to be positioned on a support surface, said mannequin being positioned on said top end;

a rod being rotatably coupled to said base, said rod extending upwardly from said top end, said rod extending upwardly through a heel portion of an associated one of said legs of said mannequin and into said associated one of said legs such that said mannequin is movably coupled to said base, said heel portion being aligned with a foot portion being angled away from said heel portion such that said foot portion extends in alignment with said rod wherein said foot portion is configured to partially obscure said rod portion from being viewed;

an actuating array being coupled to said mannequin, said actuating array being in mechanical communication with each of said arms, each of said legs and said head, said actuating array urging each of said arms, each of said legs and said head to move with respect to said torso wherein said mannequin is configured to mimic human motion, each of said arms, each of said legs and said head positioning said articles of clothing in a selected pose wherein said mannequin is configured to enhance an appearance of said articles of clothing, said actuating array comprising:

a processor being positioned within said mannequin, said processor including an electronic memory, said electronic memory being configured to store a movement routine, a plurality of arm motors, each of said arm motors being electrically coupled to said processor such that said processor selectively actuates each of said arm motors, each of said arm motors being positioned within said mannequin, each of said arm motors being positioned at an associated one of a shoulder, an elbow and a wrist of an associated one of said arms, said arm motors urging each of said arms to move in a selected direction with respect to said torso, a plurality of leg motors, each of said leg motors being electrically coupled to said processor such that said processor selectively actuates each of said leg motors, each of said leg motors being positioned within said mannequin, each of said leg motors being positioned at an associated one of a hip, a knee and an ankle of an associated one of said legs, said leg motors urging each of said legs to move in a selected direction with respect to said torso, a head motor being positioned within said mannequin, said head motor being electrically coupled to said processor such that said processor selectively actuates said head motor, said head motor being positioned at a neck between said head and said torso, said head motor urging said head to move with respect to said torso, a rod motor being positioned within said base, said rod motor being electrically coupled to said processor such that said processor selectively actuates said rod motor, said rod motor being coupled to said rod such that said rod motor rotates said rod having said mannequin rotating on said base, a camera being coupled to said head wherein said camera is configured to record images, said camera being electrically coupled to said processor, a speaker being coupled to said head wherein said speaker is configured to emit audible sounds, said speaker being electrically coupled to said processor, a transceiver being positioned within said mannequin, said transceiver being electrically coupled to said processor, said transceiver being configured to be in communication with an extrinsic electronic device thereby facilitating the extrinsic electronic device to communicate the movement routine to said electronic memory, and a power supply being positioned within said base, said power supply being electrically coupled to said processor, said power supply comprising at least one battery, said power supply further comprising a power port being coupled to said base, power port being electrically coupled to said battery such that said power port charges said battery, said power port being configured to be electrically coupled to a power source.

* * * * *